US007598210B2

(12) United States Patent
Olliges

(10) Patent No.: US 7,598,210 B2
(45) Date of Patent: Oct. 6, 2009

(54) HIGH TEMPERATURE LUBRICANT COMPOSITION

(75) Inventor: William E. Olliges, Palm City, FL (US)

(73) Assignee: Advanced Lubrication Technology Inc., Westlake Village, CA (US)

( * ) Notice: Subject to any disclaimer, the term of this patent is extended or adjusted under 35 U.S.C. 154(b) by 129 days.

(21) Appl. No.: 11/036,049

(22) Filed: Jan. 13, 2005

(65) Prior Publication Data

US 2006/0154830 A1 Jul. 13, 2006

(51) Int. Cl.
*C10M 125/26* (2006.01)
*C10M 105/38* (2006.01)

(52) U.S. Cl. ..... 508/155; 508/485

(58) Field of Classification Search ..... 508/155, 508/485

See application file for complete search history.

(56) References Cited

U.S. PATENT DOCUMENTS

| | | | | |
|---|---|---|---|---|
| 4,064,058 | A | | 12/1977 | Walker |
| 4,612,128 | A | | 9/1986 | Uematsu et al. |
| 4,826,633 | A | | 5/1989 | Carr et al. |
| 5,415,791 | A | | 5/1995 | Chou et al. |
| 5,458,794 | A | | 10/1995 | Bardasz et al. |
| 5,462,683 | A | * | 10/1995 | Kinoshita et al. ..... 508/137 |
| 5,503,761 | A | | 4/1996 | Ashcraft, Jr. et al. |
| 5,569,643 | A | * | 10/1996 | Kinoshita et al. ..... 508/155 |
| 5,658,863 | A | | 8/1997 | Duncan et al. |
| 5,681,800 | A | | 10/1997 | Duncan et al. |
| 5,733,853 | A | | 3/1998 | Bardasz et al. |
| 5,750,750 | A | * | 5/1998 | Duncan et al. ..... 554/117 |
| 5,767,047 | A | | 6/1998 | Duncan et al. |
| 5,942,474 | A | | 8/1999 | Tiffany et al. |
| 5,994,278 | A | | 11/1999 | Duncan et al. |
| 6,010,984 | A | | 1/2000 | Heimann et al. |
| 6,177,387 | B1 | | 1/2001 | Schlosberg et al. |
| 6,235,687 | B1 | | 5/2001 | Nadasdi et al. |
| 6,245,725 | B1 | * | 6/2001 | Tanaka et al. ..... 508/365 |
| 6,436,881 | B1 | | 8/2002 | McHenry et al. |
| 6,569,816 | B2 | | 5/2003 | Oohira et al. |
| 6,649,574 | B2 | | 11/2003 | Cardis et al. |
| 6,649,576 | B2 | | 11/2003 | Bell et al. |
| 6,734,147 | B2 | | 5/2004 | Levy |
| 6,750,182 | B1 | | 6/2004 | Nadasdi |
| 2003/0069147 | A1 | | 4/2003 | Kawamura et al. |
| 2003/0220205 | A1 | | 11/2003 | Manka et al. |

* cited by examiner

*Primary Examiner*—Glenn Caldarola
*Assistant Examiner*—Jim Goloboy

(57) ABSTRACT

Disclosed is a high temperature lubricant composition containing from about 85 to about 98 wt. % of a neopolyol ester; (2); from about 2 to about 10 wt. % boron nitride powder, and (3) from about 0.1 to about 5 wt. % of a linker/surfactant based on the combined weight of (1), (2) and (3).

6 Claims, No Drawings

HIGH TEMPERATURE LUBRICANT COMPOSITION

BACKGROUND OF THE INVENTION

1. Field of the Invention

This invention relates to the chemical arts. In particular, this invention relates to lubricant compositions used for high temperature applications.

2. Discussion of the Related Art

Lubricating compositions are used to reduce friction between surfaces, which are moving with respect to each other. Lubricant compositions prevent contact between the moving surfaces, thus preventing harmful wear.

Lubricants in commercial use today are prepared from a variety of natural and synthetic base stocks admixed with various additives, depending upon their intended application. The base stocks typically include mineral oils, highly refined mineral oils, poly alpha olefins (PAO), polyalkylene glycols (PAG), and phosphate esters, as well as silicone esters, diesters and polyol esters.

Thermal and oxidative stability requirements and the accompanying need for lubricant compositions with greater stability have been increasing. In end uses where higher stability is desired or required, polyol esters have been commonly used due to their high thermal and oxidative stability. Among the most demanding lubricant applications in terms of thermal and oxidative requirements are lubricants used in high temperature ovens and aluminum extrusion operations, where operating temperatures and exposure to oxygen are both high.

Accordingly, there remains a need for a lubricating composition possessing desirable thermal and oxidative stability under high temperature conditions, such as the conditions attendant to high temperature ovens and aluminum extrusion operations. The present invention satisfies these and provides further related advantages.

SUMMARY OF THE INVENTION

Now in accordance with the invention, there has been found a lubricant composition for high temperature application, possessing a desirable combination of high temperature and oxidative stability. The inventive lubricant composition includes (1) from about 85 to about 98 wt. %, preferably from about 91 to about 95 wt. %, of a neopolyol ester, (2) from about 2 to about 10 wt. %, preferably from about 5 to about 5 wt. %, boron nitride powder, and (3) from about 0.1 to about 5 wt. %, preferably from about 1 to about 3 wt. %, of a linker/surfactant, based on the combined weight of (1), (2), and (3).

In some preferred embodiments, the neopolyol ester is made by esterifying neopentyl glycol, trimethylolethane, trimethylolpropane, monopentaerythritol, technical grade pentaerythritol, dipentaerythritol or tripentaerythritol with a monocarboxylic acid containing from about five to about twenty-two carbon atoms. In more preferred embodiments, the neopolyol ester is made by esterifying a monocarboxylic acid containing from about five to about twelve carbon atoms.

Also, in some preferred embodiments, the boron nitride powder has a mean particle size less than about 15 microns, preferably less than about 10 microns, and more preferably less than about 1 micron. In some preferred embodiments, the linker/surfactant is a fatty acid, a fatty acid alcohol, a fatty acid ester, phosphoric acid, a phosphoric acid ester, lauryl acid ester or polyoxyethylene oleyl ether, more preferably the linker/surfactant is oleic acid, stearic acid, oleyl alcohol, polyoxyethylene stearic acid ester, polyglyceryloleic acid ester, tricresyl phosphate, lauryl acid ester or polyoxyethylene oleyl ether. In the most preferred embodiment, the linker/surfactant is oleic acid.

Particular embodiments of the invention are described below in considerable detail for the purpose of illustrating the principles of the invention. However, various modifications may be made, and the scope to the invention is not limited to the exemplary embodiments described below.

DESCRIPTION OF THE PREFERRED EMBODIMENTS

The high temperature lubricant composition in accordance with the invention contains (1) a neopolyol ester, (2) boron nitride powder and (3) a linker/surfactant. In some embodiments, the lubricant composition also contains one or more additives.

Suitable neopolyol esters are made by esterifying a neopolyol or neopolyol ether with a monocarboxylic acid. Examples of neopolyols include neopentyl glycol, trimethylolethane, trimethylolpropane, mono-pentaerythritol, technical grade pentaerythritol, dipentaerythritol, and tripentaerythritol. Suitable monocarboxylic acids range from formic acid, to acetic acid, to propionic acid, and up through long chain carboxylic acids both linear and branched. Preferably, the acids employed range from about five to about twenty-two carbon atoms, more preferably from about five to about twelve carbon atoms. Combinations of such neopolyol esters can also advantageously be employed.

Specific embodiments of the neopolyol esters are made by processes that are well known to the art or are commercially available. Suitable neopolyol ethers are disclosed, for example, in U.S. Pat. No. 6,436,881 to McHenry et al., U.S. Pat. No. 6,177,387 B1 to Schlosberg et al., U.S. Pat. No. 5,503,761 to Ashcraft et al., U.S. Pat. No. 4,826,633 to Carr et al., and U.S. Pat. No. 4,064,058 to Walker. The disclosures of these patents in their entireties are hereby incorporated by reference. Suitable neopolyol ethers are commercially available, such as Esterex NP 396, available from ExxonMobil Chemicals, Houston, Tex. The amount of neopolyol ester present in the lubricant composition is from about 85 to about 98 wt. %, preferably from about 91 to about 95 wt. %, based on the combined weight of (1), (2), and (3).

Now in accordance with the invention, it has been discovered that the thermal and oxidative stability of such lubricant compositions is significantly improved if the lubricant compositions contain a boron nitride powder. Suitable boron nitride powders generally are single-crystal hexagonal platelets having a mean particle size less than about 15 microns, preferably less than about 10 microns, and more preferably less than about 1 micron and greater than 99% 325 mesh. Suitable powders are commercially available, such as HCP, available from GE Advanced Ceramics Div., Strongsville, Ohio (hexagonal graphitic with a mean particle size of 7-10 microns). The amount of boron nitride powder present in the lubricant composition is from about 2 to about 10 wt. %, preferably from about 5 to about 7 wt. %, based on the combined weight of (1), (2), and (3).

The lubricant composition also contains a linker/surfactant. Representative linker/surfactants include a fatty acid such as oleic acid and stearic acid; a fatty acid alcohol such as oleyl alcohol; a fatty acid ester such as polyoxyethylene stearic acid ester and polyglyceryloleic acid ester; phosphoric acid; a phosphoric acid ester such as tricresyl phosphate; lauryl acid ester; and polyoxyethylene oleyl ether. Among them, oleic acid is preferred. The amount of linker/surfactant present in the lubricant composition is from about 0.1 to about 5 wt. %, preferably from about 1 to about 3 wt. %, based on the combined weight of (1), (2), and (3).

The inventive lubricant compositions can also contain one or more conventional lubricant additives. For example, the lubricant compositions can be used in the formulation of high temperature ovens or in aluminum extrusion operations together with selected lubricant additives. Suitable additives include, but are not limited to, antioxidants, metal inactivators, thickeners, anti-wear agents, and extreme pressure agents, as well as viscosity index improvers, dispersants, anti-emulsifying agents, color stabilizers, detergents, rust preventatives, and pour point depressants.

Representative antioxidants include, but are not limited to, phenate sulfides; phosphosulfurized terpenes; sulfurized esters; aromatic amines, such as phenyl-1-naphtylamine, phenyl-2-naphtylamine, diphenyl-p-phenylenediamine, dipyridylamine, phenothiazine, N-methylphenothiazine, N-ethylphenothiazine, 3,7-dioctylphenothiazine, P,P'-dioctyldiphenylamine, N,N'-diisopropyl-p-phenylenediamine, and N,N'-di-sec-butyl-p-phenylenediamine; and phenol-based compounds, such as 2,6-di-tert-dibutylphenol and hindered phenols, such as hindered, ester-substituted phenols.

Representative metal inactivators include, but are not limited to, benzotriazole, benzimidazole, 2-alkyldithiobenzimidazoles, 2-alkyldithio-benzothiazoles, 2-(N,N-dialkyldithiocarbamoyl)benzothiazoles, 2,5-bis(alkyl-dithio)-1,3,4-thiadiazoles, and 2,5-bis(N,N-dialkyldithiocarbamoyl)-1,3,4-thiadiazoles.

The thickener can comprise any material that in combination with the neopolyol ester will produce a semi-fluid or solid structure. Representative thickeners include soaps of aluminum, lithium, barium, sodium, calcium, mixtures thereof, silicas, clays, TEFLON® fluoropolymers, polyethylene, and mixtures thereof.

Representative anti-wear agents include, but are not limited to, tricresyl phosphate, dithiophosphates, metal stearates, zinc oxide, borax, ammonium molybdate, calcium carbonate, and mixtures thereof.

Representative extreme pressure agents include, but are not limited to, graphite, triphenyl phosphorothionate, chlorinated paraffins, dithio-carbonates, fatty oils, phosphate additives of fatty acids or fatty acid esters, sulfurized fatty oils, fatty acids, or fatty acid esters, molybdenum disulfide, tungsten disulfide, phosphate esters, phosphorous-sulfur containing compounds, and mixtures thereof. The additives are used in such amounts so as to provide their normal attendant functions, typically in the range of between about 0.01 to about 10.0 weight percent each, based on the total weight of the composition.

The lubricant compositions of this invention are made by mixing the neopolyol ester, the boron nitride powder, and the linker/surfactant, as well as any additives, until an intimate blend is formed. In a preferred embodiment, the ingredients are added in steps. In a first step, a portion of the neopolyol ester is blended with the linker/surfactant. In a second step, the boron nitride powder is mixed into the blend. Finally, the remainder of the neopentyl ester is added to the blend. The additives can be added during any of the steps or added in a separate step.

Also, in a preferred embodiment, the ingredients are mixed in a high shear blender. Typically the ingredients are blended at a temperature of about 160° F. However, the blending can also be done also at higher and lower temperatures, with higher temperatures being preferred to lower temperatures because of the ease of admixing.

Wherein the present invention has been described in particular with the presently preferred embodiments, it should be understood that other and further modifications, apart from those shown or suggested herein, may be made within the scope and spirit of the present invention.

What I claim is:

1. A lubricant composition, comprising:

about 85 to about 98 wt. % of pentaerythritol tetraoleate;

about 2 to about 10 wt. % of boron nitride powder having a mean particle size of about 6 microns; and about 0.1 to about 1 wt. % of a linker/surfactant comprising a fatty acid ester.

2. The lubricant composition of claim 1, further comprising an antioxidant selected from the group consisting of phenate sulfides, phosphosulfurized terpenes, and sulfurized esters.

3. The lubricant composition of claim 1, further comprising a metal inactivator.

4. The lubricant composition of claim 1, further comprising an anti-wear agent selected from the group consisting of zinc oxide, borax, ammonium molybdate, calcium carbonate, and mixtures thereof.

5. The lubricant composition of claim 1, further comprising an extreme pressure agent selected from the group consisting of graphite, triphenyl phosphorothionate, dithio-carbonates, tungsten disulfide, and mixtures thereof.

6. The lubricant composition of claim 1, comprising about 0.25 wt. % of a linker/surfactant.

* * * * *